US010405616B2

(12) United States Patent
Lin

(10) Patent No.: US 10,405,616 B2
(45) Date of Patent: Sep. 10, 2019

(54) ZIPPER HEAD ASSEMBLY STRUCTURE AND ELASTIC ELEMENT THEREOF

(71) Applicant: CHUNG CHWAN ENTERPRISE CO., LTD., Taoyuan (TW)

(72) Inventor: Yu-Pau Lin, Taoyuan (TW)

(73) Assignee: CHUNG CHWAN ENTERPRISE CO., LTD., Taoyuan (TW)

( * ) Notice: Subject to any disclaimer, the term of this patent is extended or adjusted under 35 U.S.C. 154(b) by 0 days.

(21) Appl. No.: 15/859,293

(22) Filed: Dec. 29, 2017

(65) Prior Publication Data

US 2019/0037975 A1 Feb. 7, 2019

(30) Foreign Application Priority Data

Aug. 7, 2017 (TW) ..... 106126576 A

(51) Int. Cl.
*A44B 19/26* (2006.01)
*A44B 19/30* (2006.01)

(52) U.S. Cl.
CPC ..... *A44B 19/262* (2013.01); *A44B 19/306* (2013.01)

(58) Field of Classification Search
CPC ..... A44B 19/262; A44B 19/306
See application file for complete search history.

(56) References Cited

U.S. PATENT DOCUMENTS 4,081,883 A * 4/1978 Ishii ..... A44B 19/306 24/421
4,139,928 A * 2/1979 Aoki ..... A44B 19/26 24/424
4,271,567 A * 6/1981 Aoki ..... A44B 19/306 24/421
4,287,646 A * 9/1981 Kanzaka ..... A44B 19/308 24/424
4,768,263 A * 9/1988 Fukuroi ..... A44B 19/306 24/418
5,896,628 A * 4/1999 Oda ..... A44B 19/306 24/421

(Continued)

FOREIGN PATENT DOCUMENTS

| | | |
|---|---|---|
| CN | 1179290 A | 4/1998 |
| CN | 204519580 U | 8/2015 |
| TW | 529357 | 4/2003 |

*Primary Examiner* — Robert Sandy
*Assistant Examiner* — David M Upchurch
(74) *Attorney, Agent, or Firm* — Li & Cai Intellectual Property (USA) Office

(57) ABSTRACT

The present invention provides a zipper head assembly structure, including a sliding element, an elastic element and a pulling element. The sliding element has a first front mating portion, a first middle mating portion and a first rear mating portion. The elastic element is disposed on the sliding element. The elastic element has a second front mating portion mated with the first front mating portion, a second middle mating portion mated with the first middle mating portion, and a second rear mating portion mated with the first rear mating portion. The pulling element has a pivotal portion pivotally disposed between the sliding element and the elastic element. The second middle mating portion extends inwardly from a middle body of the elastic element, and the width W1 of the middle body and the width W2 of the second middle mating portion conform to the equation: $(W1-W2)/2 \geq W2$.

10 Claims, 8 Drawing Sheets

(56) References Cited

U.S. PATENT DOCUMENTS

| | | | | |
|---|---|---|---|---|
| 6,588,072 | B1 * | 7/2003 | Lin | A44B 19/265 24/416 |
| 6,637,078 | B2 * | 10/2003 | Nagata | A44B 19/306 24/419 |
| 6,769,156 | B1 * | 8/2004 | Chen | A44B 19/306 24/419 |
| 8,584,326 | B2 * | 11/2013 | Keyaki | A44B 19/306 24/420 |
| 8,782,857 | B2 * | 7/2014 | Keyaki | A44B 19/306 24/421 |
| 2005/0076480 | A1 * | 4/2005 | Chen | A44B 19/306 24/415 |
| 2011/0041297 | A1 * | 2/2011 | Iwase | A44B 19/306 24/418 |
| 2012/0291236 | A1 * | 11/2012 | Lin | A44B 19/26 24/429 |
| 2012/0297584 | A1 * | 11/2012 | Lin | A44B 19/306 24/429 |
| 2013/0174387 | A1 * | 7/2013 | Hamada | A44B 19/306 24/418 |

* cited by examiner

ZIPPER HEAD ASSEMBLY STRUCTURE AND ELASTIC ELEMENT THEREOF

FIELD OF THE INVENTION

The present disclosure relates to an assembly structure and an elastic element thereof, and more particularly to a zipper head assembly structure and an elastic element thereof.

BACKGROUND OF THE INVENTION

Generally, articles of clothing rely on either buttons or zippers to bind themselves together. In contrast to the button, however, the zipper provides stronger structural integrity and a smoother operation. A zipper assembly usually includes a zipper head and a strip, the former of which serves as the connecting component with the latter and cooperates therewith to allow the zipper assembly to be zipped back and forth.

SUMMARY OF THE INVENTION

One aspect of the present disclosure relates to a zipper head assembly structure and an elastic element thereof.

One of the embodiments of the present disclosure provides a zipper head assembly structure, including a sliding element, an elastic element and a pulling element. The sliding element has a bottom sliding body, a top sliding body corresponding to the bottom sliding body, and a lateral connecting body connected between an end portion of the bottom sliding body and an end portion of the top sliding body. The top sliding body has a first front mating portion and a first middle mating portion, and the lateral connecting body has a first rear mating portion. The elastic element is disposed on the sliding element. The elastic element has a middle body, a first extending body extending outwardly from a first side of the middle body, and a second extending body extending outwardly from a second side of the middle body. The first extending body has a second front mating portion mated with the first front mating portion, the middle body has a second middle mating portion mated with the first middle mating portion, and the second extending body has a second rear mating portion mated with the first rear mating portion. The pulling element has a pivotal portion pivotally disposed between the sliding element and the elastic element. The first front mating portion, the first middle mating portion and the first rear mating portion are respectively mated with the second front mating portion, the second middle mating portion and the second rear mating portion so as to restrict the position of the elastic element to be on the sliding element. The second middle mating portion extends inwardly from the middle body, and the middle body and the second middle mating portion conform to the following equation: $(W1-W2)/2 \geq W2$, wherein W1 is a width of the middle body, and W2 is a width of the second middle mating portion.

Another one of the embodiments of the present disclosure provides a zipper head assembly structure, including a sliding element, an elastic element and a pulling element. The sliding element has a first front mating portion, a first middle mating portion and a first rear mating portion. The elastic element is disposed on the sliding element. The elastic element has a second front mating portion mated with the first front mating portion, a second middle mating portion mated with the first middle mating portion, and a second rear mating portion mated with the first rear mating portion. The pulling element has a pivotal portion pivotally disposed between the sliding element and the elastic element. The second middle mating portion extends inwardly from a middle body of the elastic element, and the middle body and the second middle mating portion conform to the following equation: $(W1-W2)/2 \geq W2$, wherein W1 is a width of the middle body, and W2 is a width of the second middle mating portion.

Yet another one of the embodiments of the present disclosure provides an elastic element disposed on a sliding element, and the sliding element has a first front mating portion, a first middle mating portion and a first rear mating portion. The elastic element includes a middle body, a first extending body extending outwardly from a first side of the middle body, and a second extending body extending outwardly from a second side of the middle body. The first extending body has a second front mating portion mated with the first front mating portion, the middle body has a second middle mating portion mated with the first middle mating portion, and the second extending body has a second rear mating portion mated with the first rear mating portion. The second middle mating portion extends inwardly from the middle body, and the middle body and the second middle mating portion conform to the following equation: $(W1-W2)/2 \geq W2$, wherein W1 is a width of the middle body, and W2 is a width of the second middle mating portion.

Therefore, by matching the features of "the first extending body 21 has a second front mating portion 211 mated with the first front mating portion 121, the middle body 20 has a second middle mating portion 201 mated with the first middle mating portion 122, and the second extending body 22 has a second rear mating portion 221 mated with the first rear mating portion 131" and "the second middle mating portion 201 extends inwardly from the middle body 20, and the width W1 of the middle body 20 and the width W2 of the second middle mating portion 201 conform to the following equation: $(W1-W2)/2 \geq W2$", the structure strength of the middle body 20 can be increased due to the relationship between the width W1 of the middle body 20 and the width W2 of the second middle mating portion 201. Hence, the overall structure strength of the elastic element 2 can be reinforced by virtue of the middle body 20.

To further understand the techniques, means and effects of the present disclosure, the following detailed descriptions and appended drawings are hereby referred to, such that, and through which, the purposes, features and aspects of the present disclosure can be thoroughly and concretely appreciated. However, the appended drawings are provided solely for reference and illustration, without any intention to limit the present disclosure.

BRIEF DESCRIPTION OF THE DRAWINGS

The accompanying drawings are included to provide a further understanding of the present disclosure, and are incorporated in and constitute a part of this specification. The drawings illustrate exemplary embodiments of the present disclosure and, together with the description, serve to explain the principles of the present disclosure.

DETAILED DESCRIPTION OF THE PREFERRED EMBODIMENTS

Embodiments of a zipper head assembly structure and an elastic element thereof according to the present disclosure are described herein. Other advantages and objectives of the present disclosure can be easily understood by one skilled in the art from the disclosure. The present disclosure can be applied in different embodiments. Various modifications and variations can be made to various details in the description for different applications without departing from the scope of the present disclosure. The drawings of the present disclosure are provided only for simple illustrations, but are not drawn to scale and do not reflect the actual relative dimensions. The following embodiments are provided to describe in detail the concept of the present disclosure, and are not intended to limit the scope thereof in any way.

It should be noted that the terms "first", "second" and "third", etc. may be used herein to describe various elements or signals; however, such terms should not be construed as limiting the elements or signals. These terms are used mainly for distinguishing one element from another, or distinguishing one signal from another. In addition, the term "or" may be used to include any one or any combination of the listed items, as the case may be.

Referring to FIG. 1 to FIG. 10, one of the embodiments of the present disclosure provides a zipper head assembly structure Z, including a sliding element 1, an elastic element 2 and a pulling element 3. The elastic element 2 is disposed on the sliding element 1, and the pulling element 3 has a pivotal portion 30 pivotally disposed between the sliding element 1 and the elastic element 2.

Figure 1:
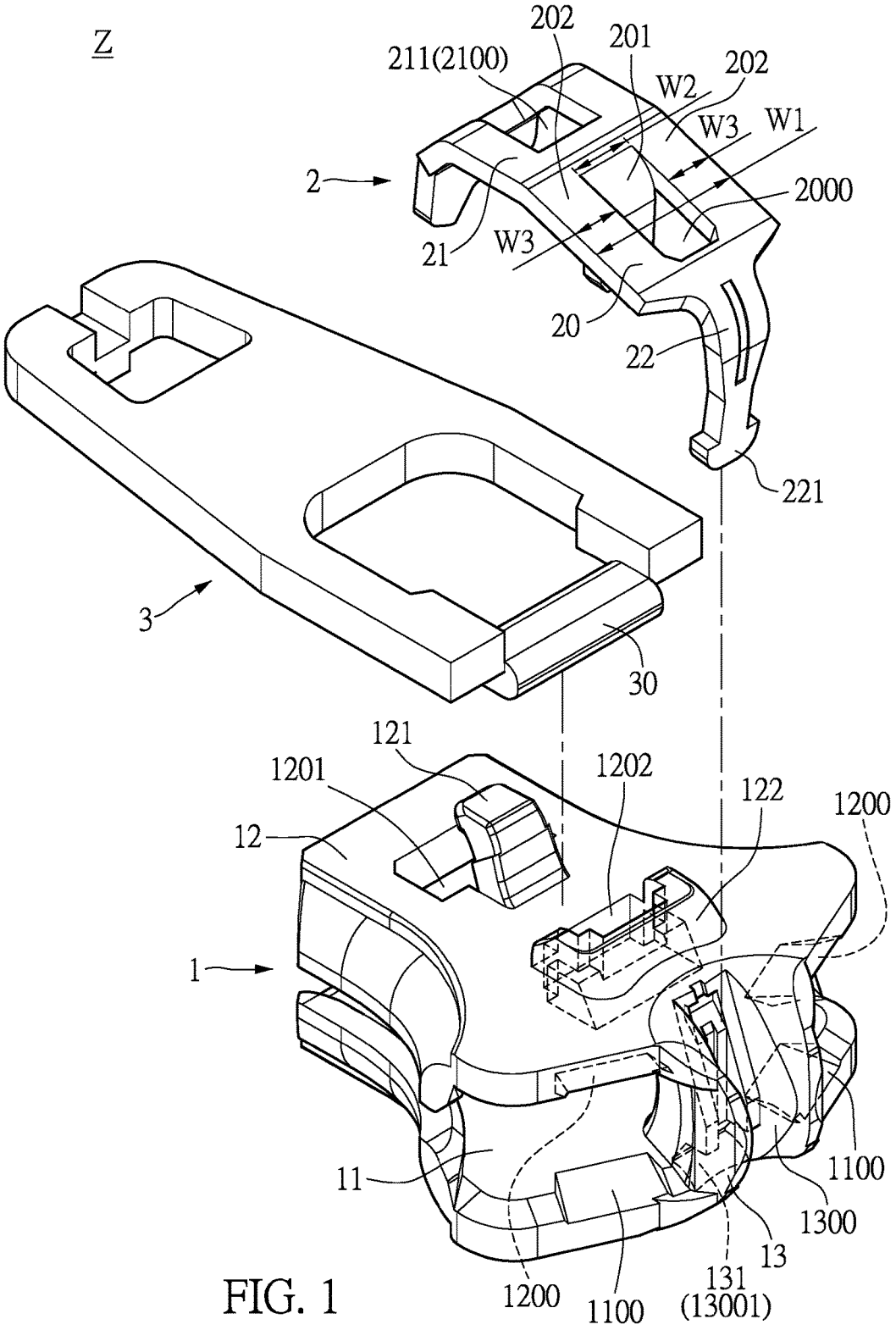
FIG. 1 shows an exploded schematic view of a zipper head assembly structure according to one of the embodiments of the present disclosure.
Figure 2:
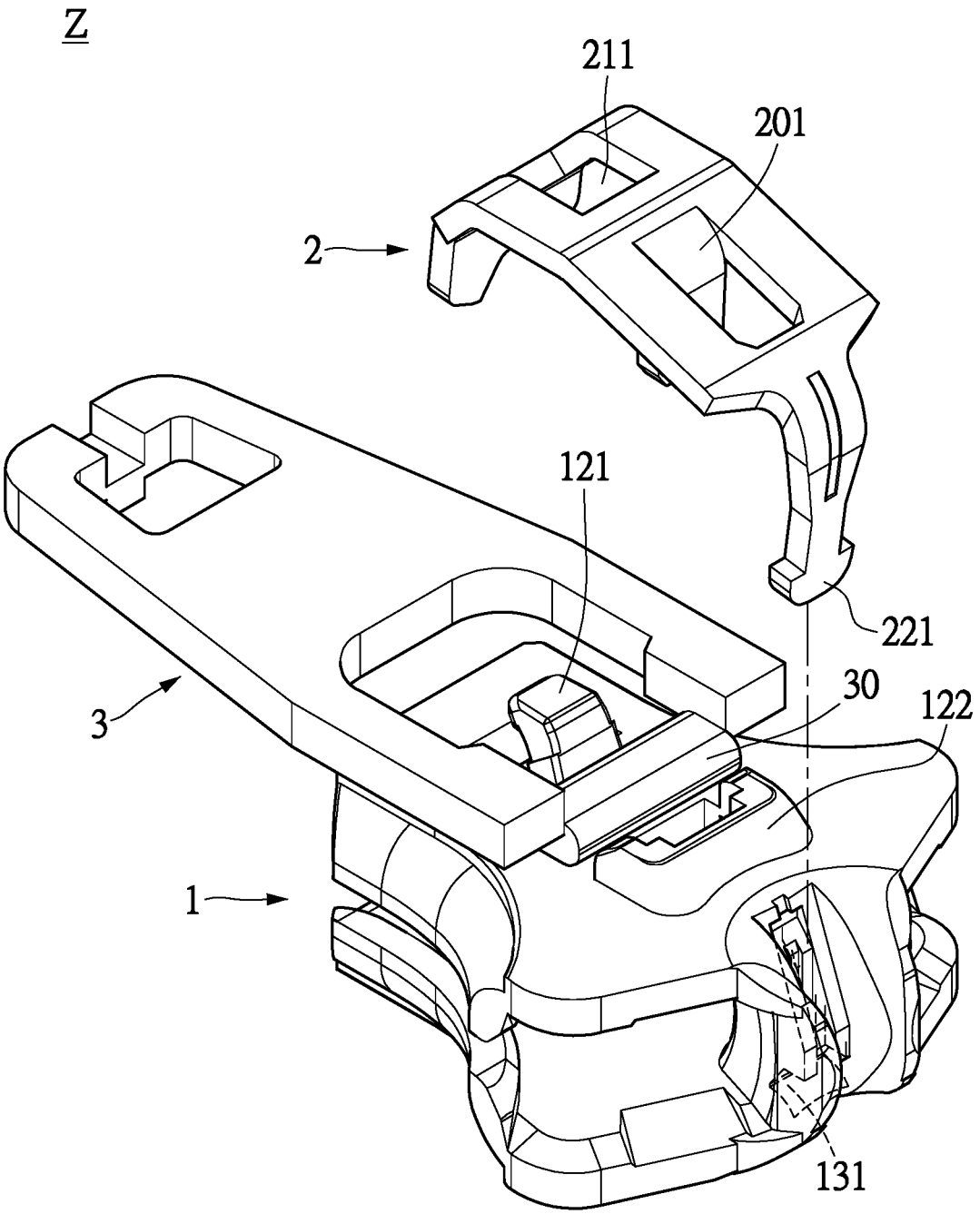
FIG. 2 shows a partial exploded schematic view of the zipper head assembly structure according to one of the embodiments of the present disclosure.
Figure 3:
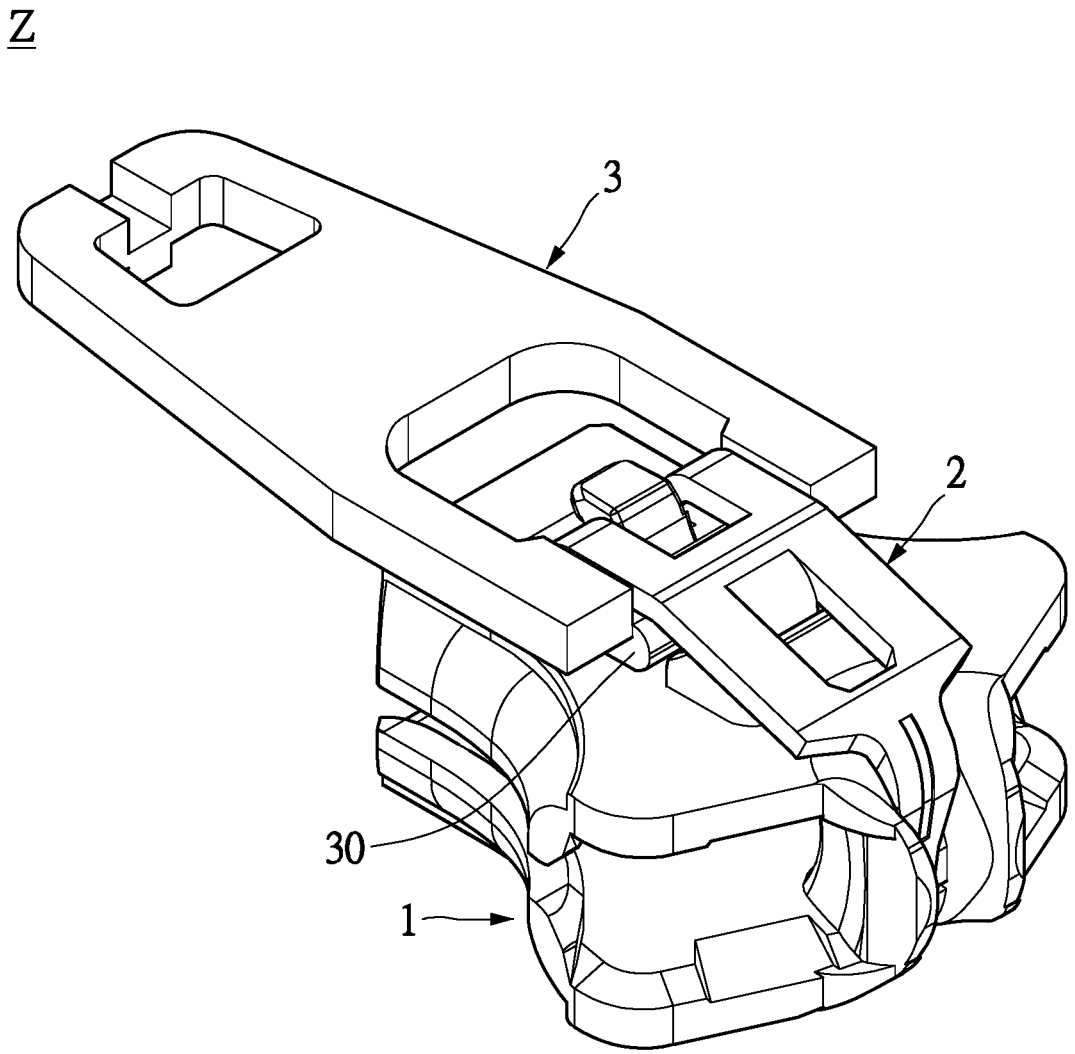
FIG. 3 shows an assembled schematic view of the zipper head assembly structure according to one of the embodiments of the present disclosure.
Figure 4:
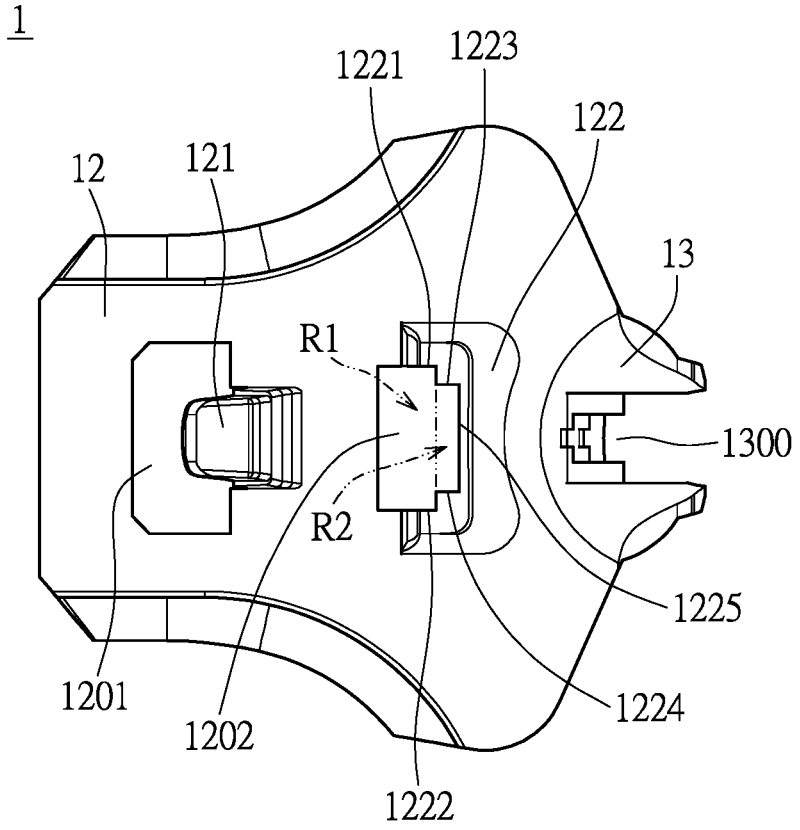
FIG. 4 shows a top schematic view of a sliding element of the zipper head assembly structure according to one of the embodiments of the present disclosure.
Figure 5:
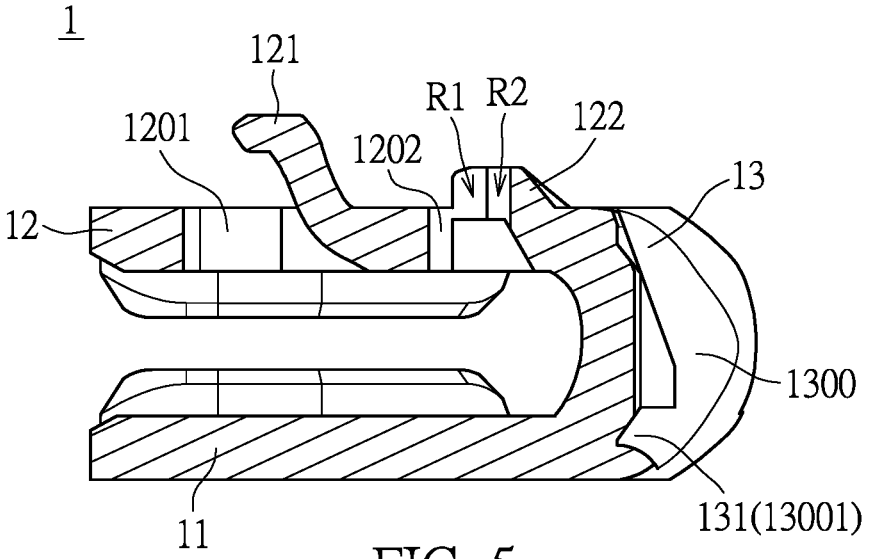
FIG. 5 shows a cross-sectional schematic view of the sliding element of the zipper head assembly structure according to one of the embodiments of the present disclosure.

Firstly, referring to FIG. 1, FIG. 4 and FIG. 5, the sliding element 1 has a bottom sliding body 11, a top sliding body 12 corresponding to the bottom sliding body 11, and a lateral connecting body 13 connected between an end portion of the bottom sliding body 11 and an end portion of the top sliding body 12, so that the bottom sliding body 11, the lateral connecting body 13 and the top sliding body 12 are connected in sequence to form a substantial U-shape. In addition, the top sliding body 12 has a first front mating portion 121 and a first middle mating portion 122, and the lateral connecting body 13 has a first rear mating portion 131.

Figure 6:
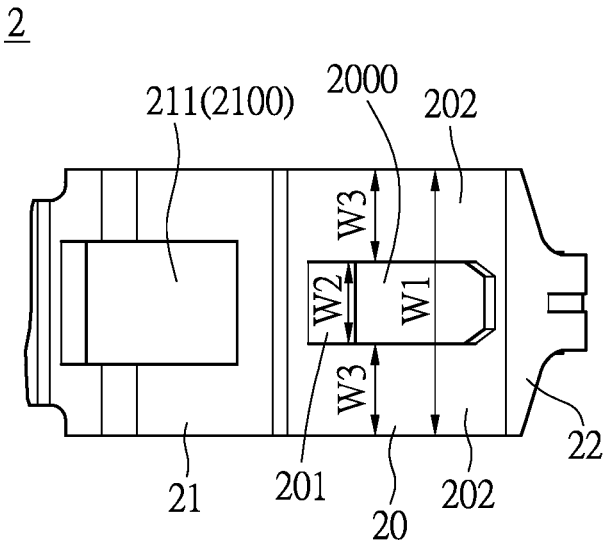
FIG. 6 shows a top schematic view of an elastic element of the zipper head assembly structure according to one of the embodiments of the present disclosure.
Figure 7:
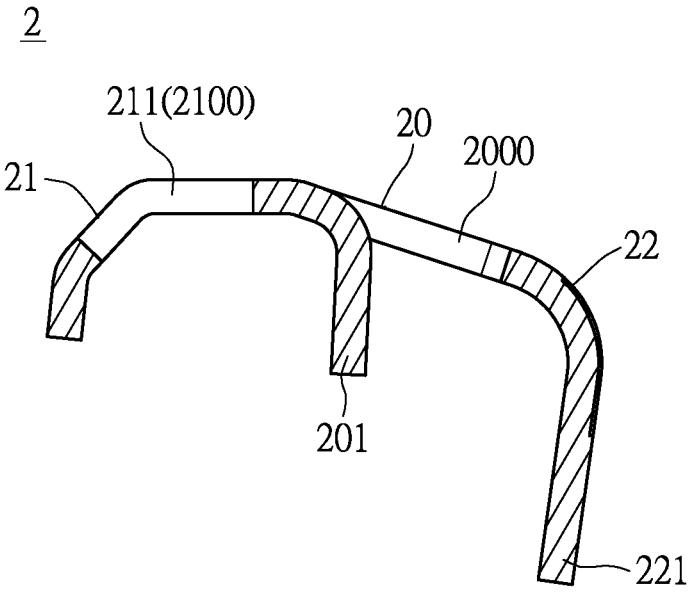
FIG. 7 shows a cross-sectional schematic view of the elastic element of the zipper head assembly structure according to one of the embodiments of the present disclosure.
Figure 8:
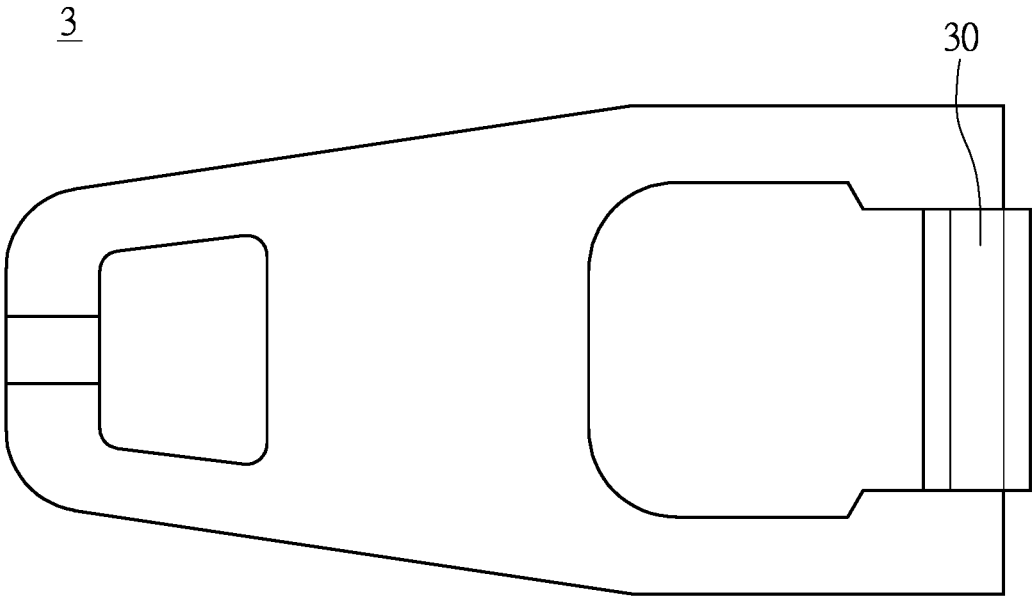
FIG. 8 shows a top schematic view of a pulling element of the zipper head assembly structure according to one of the embodiments of the present disclosure.
Figure 9:
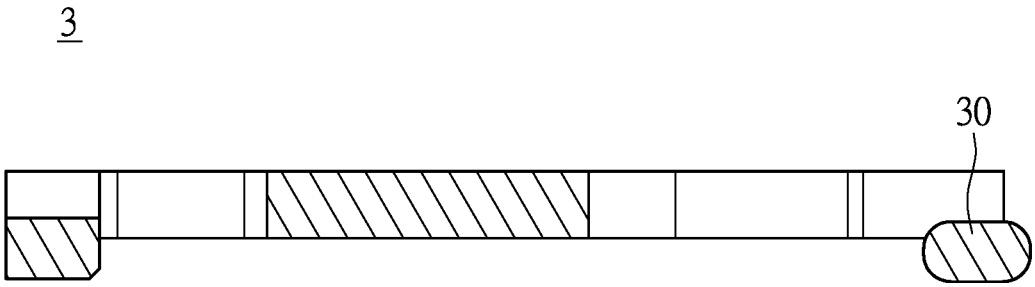
FIG. 9 shows a cross-sectional schematic view of the pulling element of the zipper head assembly structure according to one of the embodiments of the present disclosure.

Moreover, referring to FIG. 1, FIG. 6 and FIG. 7, the elastic element 2 has a middle body 20, a first extending body 21 extending outwardly from a first side of the middle body 20, and a second extending body 22 extending outwardly from a second side of the middle body 20. In addition, the first extending body 21 has a second front mating portion 211 mated with the first front mating portion 121, the middle body 20 has a second middle mating portion 201 mated with the first middle mating portion 122, and the second extending body 22 has a second rear mating portion 221 mated with the first rear mating portion 131. More particularly, referring to FIG. 1, FIG. 3 and FIG. 10, the first front mating portion 121, the first middle mating portion 122 and the first rear mating portion 131 are respectively mated with the second front mating portion 211, the second middle mating portion 201 and the second rear mating portion 221 so as to restrict or retain the elastic element 2 on the sliding element 1.

It should be noted that the second middle mating portion 201 can extend inwardly from the middle body 20 (that is to say, the second middle mating portion 201 can extend from the middle body 20 toward a direction facing the sliding element 1) as shown in FIG. 1, FIG. 6 and FIG. 7, and the middle body 20 and the second middle mating portion 201 conform to the following equation: $(W1-W2)/2 \geq W2$, wherein W1 is a width of the middle body 20, and W2 is a width of the second middle mating portion 201. Therefore, the structure strength of the middle body 20 can be increased due to the relationship between the width W1 of the middle body 20 and the width W2 of the second middle mating portion 201, so that the overall structure strength of the elastic element 2 can be reinforced by virtue of the middle body 20.

More particularly, referring to FIG. 1, FIG. 4 (or FIG. 5) and FIG. 6 (or FIG. 7), the top sliding body 12 has a first front opening 1201 and a first middle opening 1202, the first front mating portion 121 extends outwardly from the first front opening 1201, and the first middle mating portion 122 can extends outwardly from the first middle opening 1202 (that is to say, the first middle mating portion 122 can extend outwardly from the first middle opening 1202 in a direction away from the sliding element 1). In addition, the first extending body 21 has a second front opening 2100, and the middle body 20 has a second middle opening 2000. The second front mating portion 211 can be used as the second front opening 2100, and the second middle mating portion 201 can extend inwardly from the second middle opening 2000 (that is to say, the second middle mating portion 201 can extend inwardly from the second middle opening 2000 toward a direction facing the sliding element 1). Moreover, the lateral connecting body 13 has a limited space 1300 for receiving the second extending body 22, and the first rear mating portion 131 can be used as a positioning groove 13001 formed in the limited space 1300.

Figure 10:
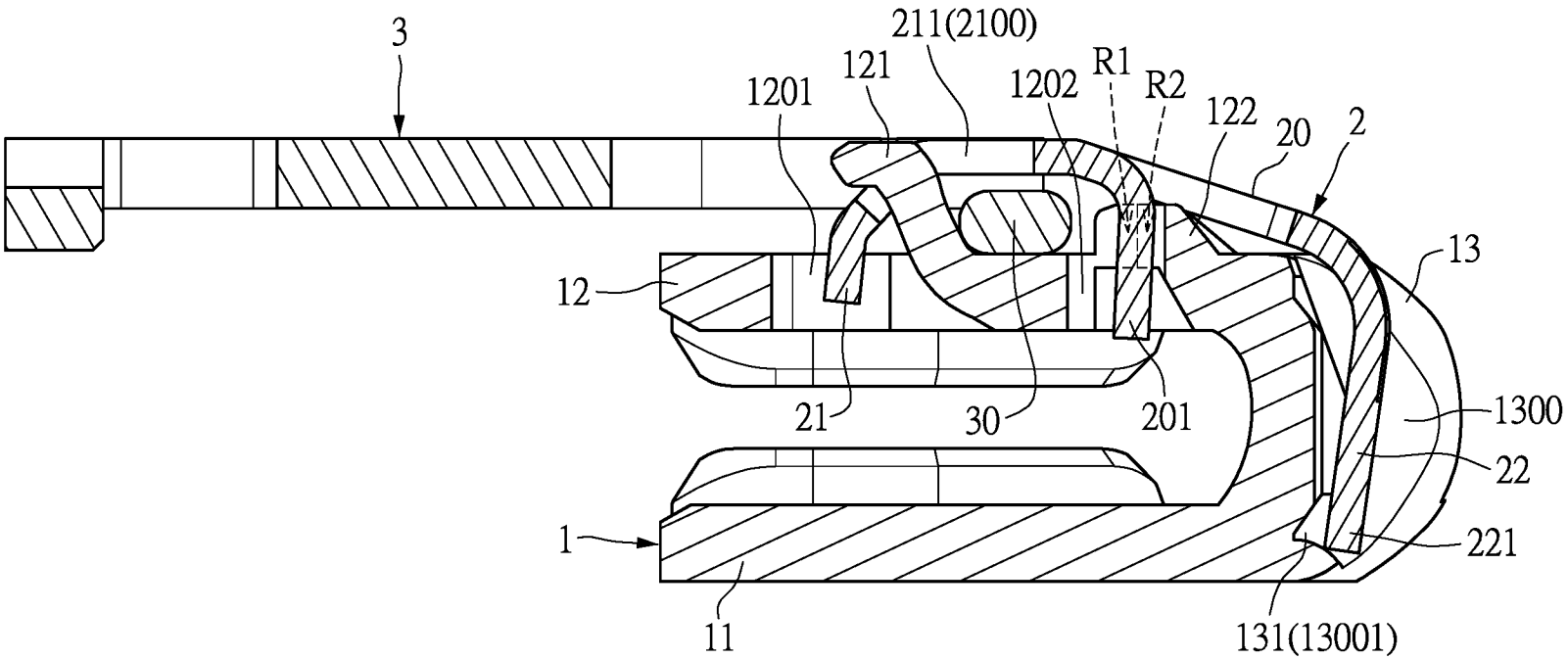
FIG. 10 shows a cross-sectional schematic view of the pulling element being placed in a horizontal position according to one of the embodiments of the present disclosure.
Figure 11:
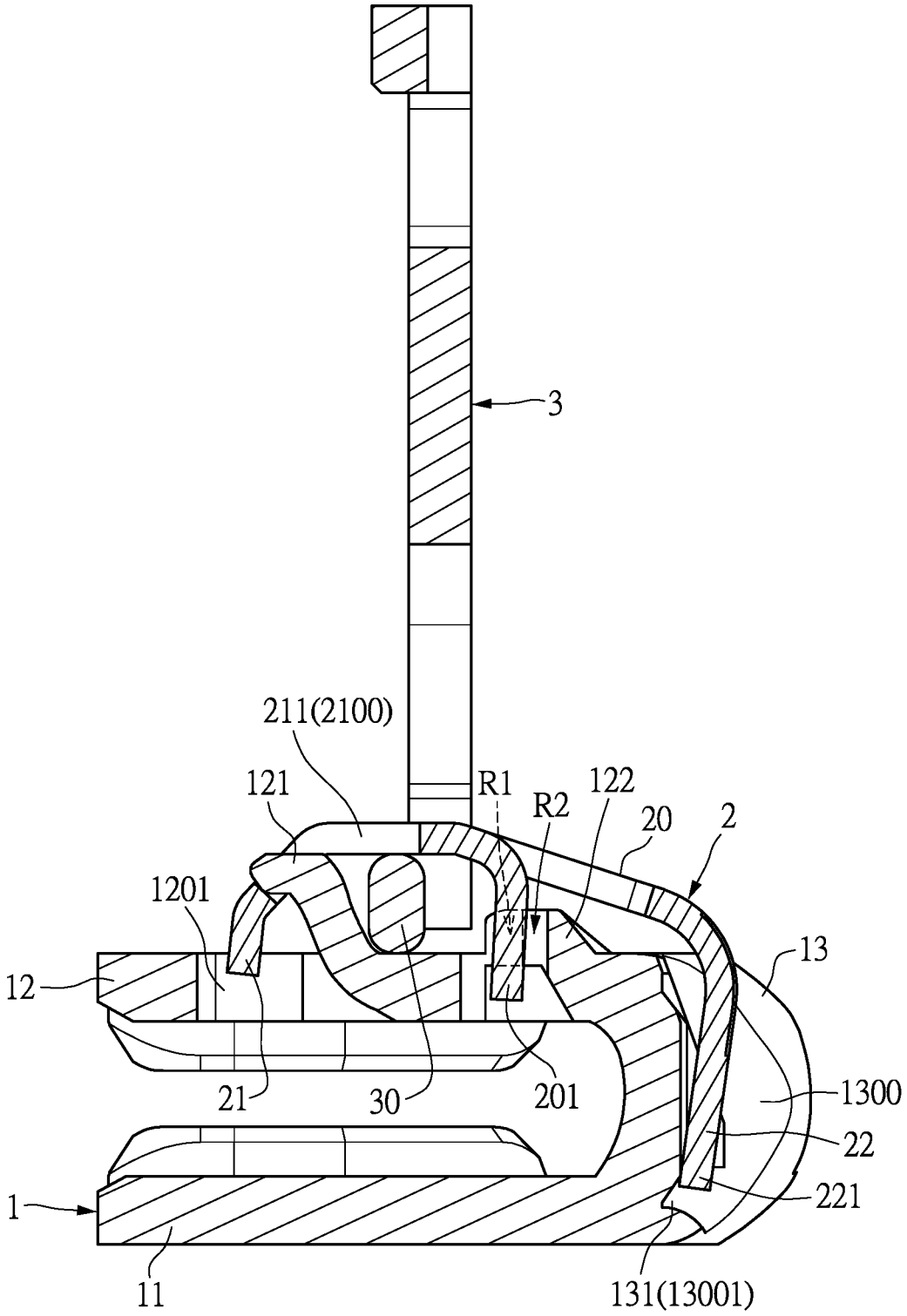
FIG. 11 shows a cross-sectional schematic view of the pulling element being placed in a vertical position according to one of the embodiments of the present disclosure.

More particularly, referring to FIG. 1, FIG. 4 (or FIG. 5), FIG. 6 (or FIG. 7) and FIG. 10 (or FIG. 11), the first extending body 21 has an end portion inserted into and passing through the first front opening 1201, and the first front mating portion 121 can be inserted into and pass through the second front opening 2100 and can be retained with the second front opening 2100. In addition, the second middle mating portion 201 can be inserted into and pass through the first middle opening 1202 and can abut against the first middle mating portion 122 (as shown in FIG. 11), and the second rear mating portion 221 of the second extending body 22 can be inserted into the positioning groove 13001 of the limited space 1300 and fixedly engaged with the positioning groove 13001.

It should be noted that, the bottom sliding body 11 has two first inclined guiding surfaces 1100 formed on an edge portion thereof and respectively disposed beside two opposite sides of the lateral connecting body 13, the top sliding body 12 has two second inclined guiding surfaces 1200 formed on an edge portion thereof and respectively disposed beside the two opposite sides of the lateral connecting body 13, and the two first inclined guiding surfaces 1100 respectively face the two second inclined guiding surfaces 1200, as shown in FIG. 1. Therefore, when the zipper head assembly structure Z slides on a zipper chain (not shown), the smoothness of the sliding operation can be increased by cooperation of the two first inclined guiding surfaces 1100 and the two second inclined guiding surfaces 1200 that face each other.

It should be noted that referring to FIG. 4 and FIG. 5, the first middle mating portion 122 has a first left inner surface 1221, a first right inner surface 1222 corresponding to the first left inner surface 1221, a second left inner surface 1223 adjacent to the first left inner surface 1221, a second right inner surface 1224 corresponding to the second left inner surface 1223 and adjacent to the first right inner surface 1222, and a front inner surface 1225 connected between the second left inner surface 1223 and the second right inner surface 1224. In addition, the first middle mating portion 122 has a first receiving space R1 and a second receiving space R2, and the width of the first receiving space R1 can be greater than the width of the second receiving space R2. Moreover, the first receiving space R1 is formed between the first left inner surface 1221 and the first right inner surface 1222 and communicated with the first middle opening 1202, and the second receiving space R2 is formed among the second left inner surface 1223, the second right inner surface 1224 and the front inner surface 1225 and communicated with the first receiving space R1.

As described above, the second middle mating portion 201 can pass through the first receiving space R1 and the second receiving space R2, and the second middle mating portion 201 has a first portion received inside the first receiving space R1 and a second portion received inside the second receiving space R2. For example, referring to FIG. 5 and FIG. 10, when the pulling element 3 has not been moved upwardly yet and is disposed horizontally along a horizontal line (that is to say, the pulling element 3 is placed horizontally), the volume of the first portion of the second middle mating portion 201 is smaller than the volume of the second portion of the second middle mating portion 201. Referring to FIG. 5 and FIG. 11, when the pulling element 3 has been moved upwardly and is disposed vertically along a vertical line (that is to say, the pulling element 3 is placed vertically), the volume of the first portion of the second middle mating portion 201 is greater than the volume of the second portion of the second middle mating portion 201. That is to say, the volume of the first portion of the second middle mating portion 201 received inside the first receiving space R1 is smaller (as shown in FIG. 10) or greater (as shown in FIG. 11) than the volume of the second portion of the second middle mating portion 201 received inside the second receiving space R2.

More particularly, referring to FIG. 1 and FIG. 6, the middle body 20 has two lateral frame portions 202 that are separated from each other by the second middle mating portion 201, and a width W3 of one of the two lateral frame portions 202 is greater than or equal to a width W2 of the second middle mating portion 201. For example, the second middle mating portion 201 can be disposed at a central position of the middle body 20, and a width W3 (such as 1.3±0.05 mm) of each of the two lateral frame portions 202 is greater than or equal to a width W2 (such as 1.2±0.05 mm) of the second middle mating portion 201. Therefore, the structure strength of the middle body 20 can be increased due to the relationship between the width W2 of the second middle mating portion 201 and the width W3 of each lateral frame portion 202, so that the overall structure strength of the elastic element 2 can be reinforced due to the middle body 20.

Therefore, by matching the features of "the first extending body 21 has a second front mating portion 211 mated with the first front mating portion 121, the middle body 20 has a second middle mating portion 201 mated with the first middle mating portion 122, and the second extending body 22 has a second rear mating portion 221 mated with the first rear mating portion 131" and "the second middle mating portion 201 is inwardly extended from the middle body 20, and the width W1 of the middle body 20 and the width W2 of the second middle mating portion 201 conform to the following equation: $(W1-W2)/2 \geq W2$", the structure strength of the middle body 20 can be increased due to the relationship between the width W1 of the middle body 20 and the width W2 of the second middle mating portion 201. Hence, the overall structure strength of the elastic element 2 can be reinforced due to the middle body 20.

The aforementioned descriptions merely represent the preferred embodiments of the present disclosure, without any intention to limit the scope of the present disclosure which is fully described only within the following claims. Various equivalent changes, alterations or modifications based on the claims of the present disclosure are all, consequently, viewed as being embraced by the scope of the present disclosure.

What is claimed is:

1. A zipper head assembly structure, comprising:

a sliding element having a bottom sliding body, a top sliding body corresponding to the bottom sliding body, and a lateral connecting body connected between an end portion of the bottom sliding body and an end portion of the top sliding body, wherein the top sliding body has a first front mating portion and a first middle mating portion, and the lateral connecting body has a first rear mating portion;

an elastic element disposed on the sliding element, wherein the elastic element has a middle body, a first extending body extending outwardly from a first side of the middle body, and a second extending body extending outwardly from a second side of the middle body, the first extending body has a second front mating portion mated with the first front mating portion, the middle body has a second middle mating portion mated with the first middle mating portion, and the second extending body has a second rear mating portion mated with the first rear mating portion; and a pulling element having a pivotal portion pivotally disposed between the sliding element and the elastic element;

wherein the first front mating portion, the first middle mating portion and the first rear mating portion are respectively mated with the second front mating portion, the second middle mating portion and the second rear mating portion so as to restrict the position of the elastic element to be on the sliding element;

wherein the second middle mating portion is formed without any through hole for receiving the first middle mating portion;

wherein the second middle mating portion is inwardly extended from the middle body, and the middle body and the second middle mating portion conform to the following equation: $(W1-W2)/2 \geq W2$, wherein W1 is a width of the middle body, and W2 is a width of the second middle mating portion.

2. The zipper head assembly structure of claim 1, wherein the top sliding body has a first front opening and a first middle opening, the first front mating portion extends outwardly from the first front opening, and the first middle mating portion extends outwardly from the first middle opening, wherein the first extending body has a second front opening, the middle body has a second middle opening, the second front mating portion is the second front opening, and the second middle mating portion extends inwardly from the second middle opening, wherein the first extending body has an end portion passing through the first front opening, the first front mating portion passes through the second front opening and fixedly engages with the second front opening, and the second middle mating portion passes through the first middle opening and abuts against the first middle mating portion, wherein the lateral connecting body has a limited space for receiving the second extending body, the first rear mating portion is a positioning groove formed inside the limited space, and the second rear mating portion of the second extending body is inserted into the positioning groove of the limited space and fixedly engaged with the positioning groove, wherein the second middle mating portion is disposed at a central position of the middle body, the middle body has two lateral frame portions that are separated from each other by the second middle mating portion, and a width of each of the two lateral frame portions is greater than or equal to a width of the second middle mating portion.

3. The zipper head assembly structure of claim 2, wherein the bottom sliding body has two first inclined guiding surfaces formed on an edge portion thereof and respectively disposed beside two opposite sides of the lateral connecting body, the top sliding body has two second inclined guiding surfaces formed on an edge portion thereof and respectively disposed beside the two opposite sides of the lateral connecting body, and the two first inclined guiding surfaces respectively face the two second inclined guiding surfaces, wherein the first middle mating portion has a first left inner surface, a first right inner surface corresponding to the first left inner surface, a second left inner surface adjacent to the first left inner surface, a second right inner surface corresponding to the second left inner surface and adjacent to the first right inner surface, and a front inner surface connected between the second left inner surface and the second right inner surface, wherein the first middle mating portion has a first receiving space and a second receiving space, the first receiving space is formed between the first left inner surface and the first right inner surface and communicated with the first middle opening, and the second receiving space is formed among the second left inner surface, the second right inner surface and the front inner surface and communicated with the first receiving space, wherein the second middle mating portion passes through the first receiving space and the second receiving space, the second middle mating portion has a first portion received inside the first receiving space and a second portion received inside the second receiving space, and the volume of the first portion of the second middle mating portion is smaller or greater than the volume of the second portion of the second middle mating portion, wherein the middle body has two lateral frame portions that are separated from each other by the second middle mating portion, and a width of one of the two lateral frame portions is greater than or equal to a width of the second middle mating portion.

4. A zipper head assembly structure, comprising:

a sliding element having a first front mating portion, a first middle mating portion and a first rear mating portion;

an elastic element disposed on the sliding element, wherein the elastic element has a second front mating portion mated with the first front mating portion, a second middle mating portion mated with the first middle mating portion, and a second rear mating portion mated with the first rear mating portion; and a pulling element having a pivotal portion pivotally disposed between the sliding element and the elastic element;

wherein the second middle mating portion extends inwardly from a middle body of the elastic element, and the middle body and the second middle mating portion conform to the following equation: $(W1-W2)/2 \geq W2$, wherein W1 is a width of the middle body, and W2 is a width of the second middle mating portion;

wherein the second middle mating portion is formed without any through hole for receiving the first middle mating portion.

5. The zipper head assembly structure of claim 4, wherein the sliding element has a bottom sliding body, a top sliding body corresponding to the bottom sliding body, and a lateral connecting body connected between an end portion of the bottom sliding body and an end portion of the top sliding body, the first front mating portion and the first middle mating portion are disposed on the top sliding body, and the first rear mating portion is disposed on the lateral connecting body, wherein the elastic element has a first extending body extending outwardly from a first side of the middle body, and a second extending body extending outwardly from a second side of the middle body, the second front mating portion is disposed on the first extending body, the second middle mating portion is disposed on the middle body, and the second rear mating portion is disposed on the second extending body.

6. The zipper head assembly structure of claim 5, wherein the top sliding body has a first front opening and a first middle opening, the first front mating portion extends outwardly from the first front opening, and the first middle mating portion extends outwardly from the first middle opening, wherein the first extending body has a second front opening, the middle body has a second middle opening, the second front mating portion is the second front opening, and the second middle mating portion extends inwardly from the second middle opening, wherein the first extending body has an end portion passing through the first front opening, the first front mating portion passes through the second front opening and fixedly engages with the second front opening, and the second middle mating portion passes through the first middle opening and abuts against the first middle mating portion, wherein the lateral connecting body has a limited space for receiving the second extending body, the first rear mating portion is a positioning groove formed inside the limited space, and the second rear mating portion of the second extending body is inserted into the positioning groove of the limited space and fixedly engaged with the positioning groove, wherein the second middle mating portion is disposed at a central position of the middle body, the middle body has two lateral frame portions that are separated from each other by the second middle mating portion, and a width of each of the two lateral frame portions is greater than or equal to a width of the second middle mating portion.

7. The zipper head assembly structure of claim 6, wherein the bottom sliding body has two first inclined guiding surfaces formed on an edge portion thereof and respectively disposed beside two opposite sides of the lateral connecting body, the top sliding body has two second inclined guiding surfaces formed on an edge portion thereof and respectively disposed beside the two opposite sides of the lateral connecting body, and the two first inclined guiding surfaces respectively face the two second inclined guiding surfaces, wherein the first middle mating portion has a first left inner surface, a first right inner surface corresponding to the first left inner surface, a second left inner surface adjacent to the first left inner surface, a second right inner surface corresponding to the second left inner surface and adjacent to the first right inner surface, and a front inner surface connected between the second left inner surface and the second right inner surface, wherein the first middle mating portion has a first receiving space and a second receiving space, the first receiving space is formed between the first left inner surface and the first right inner surface and communicated with the first middle opening, and the second receiving space is formed among the second left inner surface, the second right inner surface and the front inner surface and communicated with the first receiving space, wherein the second middle mating portion passes through the first receiving space and the second receiving space, the second middle mating portion has a first portion received inside the first receiving space and a second portion received inside the second receiving space, and the volume of the first portion of the second middle mating portion is smaller or greater than the volume of the second portion of the second middle mating portion, wherein the middle body has two lateral frame portions that are separated from each other by the second middle mating portion, and a width of one of the two lateral frame portions is greater than or equal to a width of the second middle mating portion.

8. An elastic element disposed on a sliding element, the sliding element having a first front mating portion, a first middle mating portion and a first rear mating portion, the elastic element comprising:

a middle body;

a first extending body extending outwardly from a first side of the middle body; and a second extending body extending outwardly from a second side of the middle body;

wherein the first extending body has a second front mating portion mated with the first front mating portion, the middle body has a second middle mating portion mated with the first middle mating portion, and the second extending body has a second rear mating portion mated with the first rear mating portion;

wherein the second middle mating portion extends inwardly from the middle body, and the middle body and the second middle mating portion conform to the following equation: $(W1-W2)/2 \geq W2$, wherein W1 is a width of the middle body, and W2 is a width of the second middle mating portion;

wherein the second middle mating portion is formed without any through hole for receiving the first middle mating portion.

9. The elastic element of claim 8, wherein the first extending body has a second front opening, the middle body has a second middle opening, the second front mating portion is the second front opening, and the second middle mating portion extends inwardly from the second middle opening, wherein the second middle mating portion is disposed at a central position of the middle body, the middle body has two lateral frame portions that are separated from each other by the second middle mating portion, and a width of each of the two lateral frame portions is greater than or equal to a width of the second middle mating portion.

10. The elastic element of claim 8, wherein the middle body has two lateral frame portions that are separated from each other by the second middle mating portion, and a width of one of the two lateral frame portions is greater than or equal to a width of the second middle mating portion.

* * * * *